US006929381B2

(12) United States Patent
Peterson

(10) Patent No.: US 6,929,381 B2
(45) Date of Patent: Aug. 16, 2005

(54) SOLAR POWERED ELECTRIC CANDLE

(76) Inventor: Darlene A. Peterson, 174 Lindfield Cir., Yardley, PA (US) 19067

( * ) Notice: Subject to any disclaimer, the term of this patent is extended or adjusted under 35 U.S.C. 154(b) by 0 days.

(21) Appl. No.: 10/460,333

(22) Filed: Jun. 12, 2003

(65) Prior Publication Data

US 2004/0252492 A1 Dec. 16, 2004

(51) Int. Cl.[7] ..... F21L 4/08

(52) U.S. Cl. ..... 362/192; 362/20; 362/202; 362/392

(58) Field of Search ..... 362/192, 392, 362/20, 157, 183, 202, 382, 393, 227, 249, 252–254, 569, 447, 810; D26/1, 2, 4–7

(56) References Cited

U.S. PATENT DOCUMENTS 1,236,657 A * 8/1917 Bauer ..... 362/195
1,297,653 A * 3/1919 Burgess ..... 362/195
2,009,965 A * 7/1935 Pollock ..... 362/392
2,435,811 A * 2/1948 Waters ..... 362/569
4,510,556 A * 4/1985 Johnson ..... 362/184
4,563,727 A * 1/1986 Curiel ..... 362/183
4,816,970 A * 3/1989 Garcia, Jr. ..... 362/183
4,823,241 A * 4/1989 Trattner ..... 362/183
4,918,357 A * 4/1990 Waterbury ..... 362/183
4,999,060 A * 3/1991 Szekely et al. ..... 362/183
5,155,668 A 10/1992 Tanner et al. ..... 362/183
5,199,781 A * 4/1993 Sweeny ..... 362/145
5,255,170 A * 10/1993 Plamp et al. ..... 362/183
5,564,816 A * 10/1996 Arcadia et al. ..... 362/183
5,601,360 A * 2/1997 Paquette ..... 362/183
5,690,412 A * 11/1997 Sheldon ..... 362/183
6,309,092 B1 * 10/2001 Bardeen et al. ..... 362/392
6,497,502 B1 * 12/2002 Clift et al. ..... 362/392
6,601,977 B2 * 8/2003 Gesue ..... 362/392
6,616,308 B2 * 9/2003 Jensen et al. ..... 362/392
6,637,911 B2 * 10/2003 Sittner ..... 362/183
2004/0233681 A1 * 11/2004 Yao et al.

* cited by examiner

*Primary Examiner*—John Anthony Ward
*Assistant Examiner*—Ismael Negron
(74) *Attorney, Agent, or Firm*—LaMorte & Associates

(57) ABSTRACT

The electric candle light has an elongated shaft that appears as the stick of a wax candle. A light source is disposed at the top end of the elongated shaft. A photoelectric cell is disposed around the top end of the elongated shaft below the light source. A rechargeable battery is coupled to both the light source and the photoelectric cell. The rechargeable battery supplies electricity to the light source and is recharged by the photoelectric cell.

14 Claims, 4 Drawing Sheets

SOLAR POWERED ELECTRIC CANDLE

BACKGROUND OF THE INVENTION

1. Field of the Invention

In general, the present invention relates to battery powered illumination lights. More particularly, the present invention relates to battery powered illumination lights that contain photoelectric cells so that the batteries of the lights can recharge during daylight conditions when the light is not in use.

2. Description of the Prior Art

Since Edison's invention of the light bulb, electric lights have been used to illuminate countless objects. However, until recently, most electric lights were limited to applications where there was a steady supply of alternating current. This is mostly due to the fact that prolonged illumination of any object with a sufficient amount of light energy requires a substantial supply of electricity. Portable, direct current electric lights, such as flash lights, produce bright light for only short periods of time. Consequently, battery powered lights are generally used only when needed and are typically not relied upon to illuminate any object for a prolonged period of time.

Recently, however, there have been many advancements in the technologies that effect battery powered illumination. Those technological advancements include improvements in batteries, light sources and photoelectric cells that can be used to recharge batteries. For one, batteries now exist that can produce high current flows for prolonged periods of time and are rechargeable. Some of the more advanced rechargeable batteries have a better than 1:3 use/recharge ratio. That is, for every three hours of recharging the battery experiences at a set amperage, the battery can produce more than one hour of uninterrupted charge at that set amperage.

Another improvement is that light emitting diodes (LEDs) now exist that can produce light just as bright as incandescent light bulbs but use less than a third of the power required by incandescent light bulbs.

Lastly, advancements exist in photoelectric cell technologies that enable small photoelectric cells to produce enough electricity to recharge a rechargeable battery.

Rechargeable batteries, modern LEDs and photoelectric cells have recently been combined in many different types of rechargeable light assemblies to provide illumination at night. Such lights are used in applications where AC electrical power is not present, such as cemeteries, roadsides, and walkways. In each application, the batteries of the light charge during daylight hours and are used to illuminate lights at night. For a day with twelve hours of sunlight, many of these self-charging battery powered lights can generate light for up to five hours after dark.

Applications of self-charging battery powered lights are exemplified by U.S. Pat. No. 5,564,816 to Arcadia, entitled Illuminated Memorial Assembly, and U.S. Pat. No. 5,155,668 to Tanner entitled Solar Powered Lamp Utilizing Cold Cathode Fluorescent Illumination And Method Of Facilitating Same.

Of the prior art battery operated lights that recharge with solar power, they all share one common characteristic. That common characteristic is that the lights are intended to be placed outside. This exposes the photoelectric cells to sunlight during the day so that the batteries of the light can recharge. For lights that are used indoors, solar rechargeable lights are rarely used. This is because AC power is commonly available indoors and there typically is not enough ambient light indoors to provide the power needed to fully recharge a set of rechargeable batteries.

Indoor lights that do rely upon solar cells to recharge typically have very large areas of photoelectric cells to collect as much light energy as possible. The photoelectric cells are typically positioned near the light source so that when the light source is illuminated, some of the light energy produced can be received by the photoelectric cells and reused in the production of power. Such prior art lights are exemplified by U.S. Pat. No. 4,816,970 to Garcia, entitled Solar Powered Light.

In an indoor environment, there exist many applications for a light in places where there is no readily available AC power. It would be beneficial to provide a battery powered light in such applications, provided the battery powered light can be self-charging and thus not require a constant supply of fresh batteries. The object of this invention is therefore to create an improved self-charging light for indoor use.

SUMMARY OF THE INVENTION

The present invention is an electric candle light assembly for use in window displays. The electric candle light has the same overall appearance as a wax candle but produces light electrically. The electric candle light has an elongated shaft that appears as the stick of a candle. The elongated shaft has both a top end and a bottom end. A light source is disposed at the top end of the elongated shaft. When lit, the light source appears to be the flame of a candle. A photoelectric cell is supported at an elevated position by the elongated shaft, wherein the photoelectric cell is disposed along the length of the elongated shaft. A rechargeable battery is coupled to both the light source and the photoelectric cell. The rechargeable battery supplies electricity to the light source and is recharged by the photoelectric cell.

Control features are provided that can be used to adjust when the electric candle light turns on and when the electric candle light turns off. Various other features are provided that make the electric candle light specifically well adapted for use in a window display.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Many people like to decorate their homes by placing a candle or candles in each of the windows of the home. This is especially true during the Christian and Jewish winter holidays. Although real burning wax candles are no longer commonly used, electric lights shaped like candles are used to provide the same visual impression. However, there is seldom an available power outlet in the house near all of the windows. As such, homeowners run extension cords under the windows that are not close to power outlets. This provides each window with the ability to display an electric candle light. However, the tangle of extension cords causes the inside of the house to be cluttered with wires running along the floors. This also leaves fewer power outlets available within the home for other uses.

The present invention is an electric candle light that is battery powered and self-charging. The electric candle light charges during the day and illuminates after dark. The electric candle light therefore requires no power cord.

Figure 1:
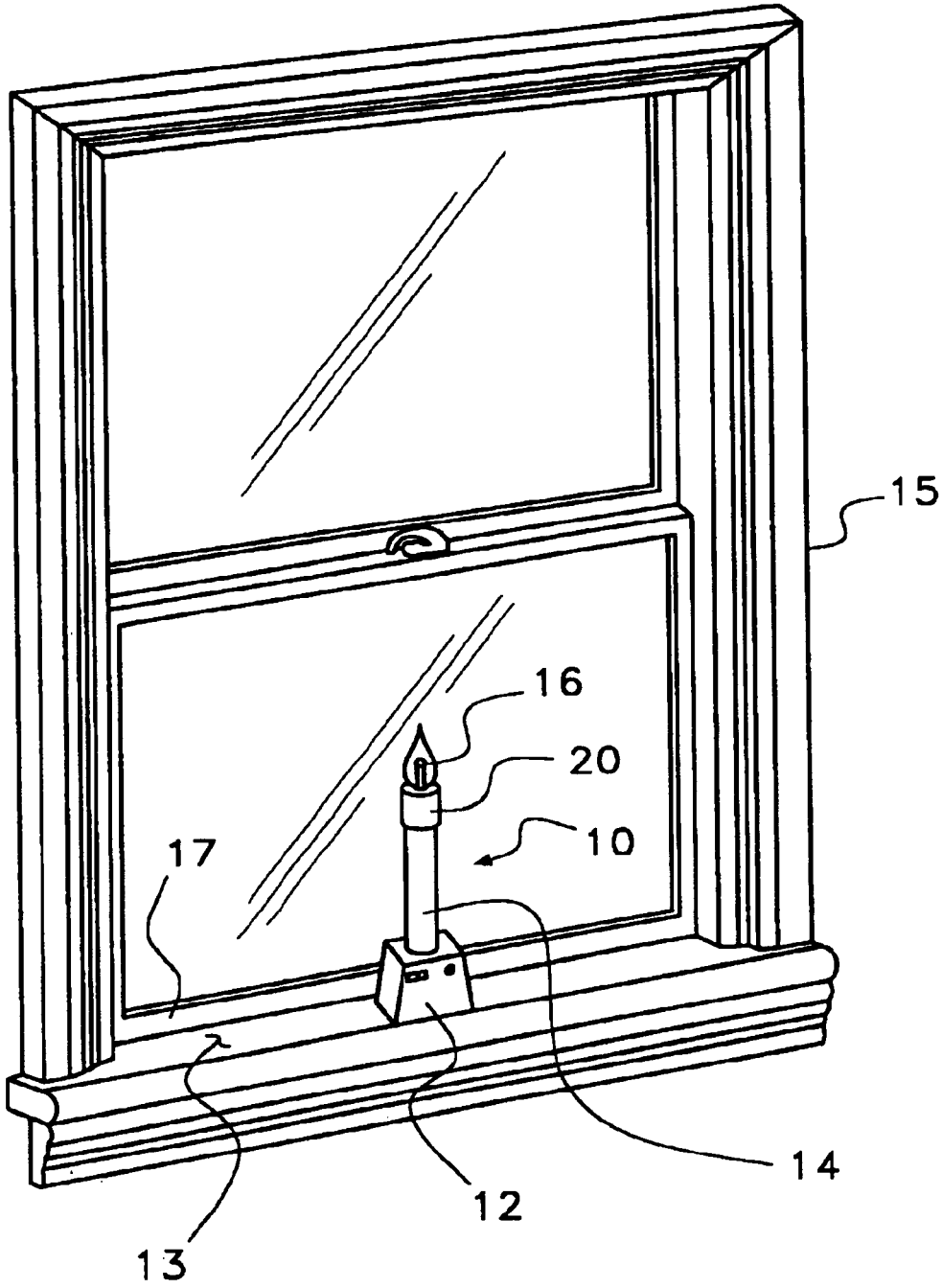
FIG. 1 shows an exemplary embodiment of the present invention electric candle light displayed in a window.

Referring to FIG. 1 an exemplary embodiment of an electric candle light 10 is shown. In this embodiment, the electric candle light 10 has a narrow base 12. The base 12 is preferably no wider than three inches so that the base 12 can rest on a narrow window sill 13 of a house window 15. A shaft 14 extends upwardly from the base 12. The shaft 14 has the appearance of the body of a wax candle. At the top end of the shaft 14 is positioned a light source 16. The light source 16 can have a tapered shape so as to look like a flame when illuminated. A collar 20 is disposed between the light source 16 and the shaft 14, thereby presenting the electric candle light 10 with a formal holiday appearance.

As can be seen from FIG. 1, the electric candle light 10 is placed on the sill 13 of a window 15 so that the electric candle light 10 can be observed from the outside of the window 15. Most all windows have some type of lower sash frame 17 that extends upwardly from the sill 13. The sash frame 17 is higher than the sill 13 and thus obstructs at least part of the candle's base 12 that is sitting on the sill 13.

As has been previously mentioned, the present invention electric candle light 10 is self-charging using solar power. Since the base 12 of the electric candle light 10 is partially blocked by the sash frame 17, the base 12 of the electric candle light 10 is not a good surface to place a photoelectric cell. Rather, the present invention uses the structure of the electric candle light 10 itself to support a photoelectric cell in an elevated position above the sill 13 so that the photoelectric cell gets full exposure to light passing through the window 15.

Figure 2:
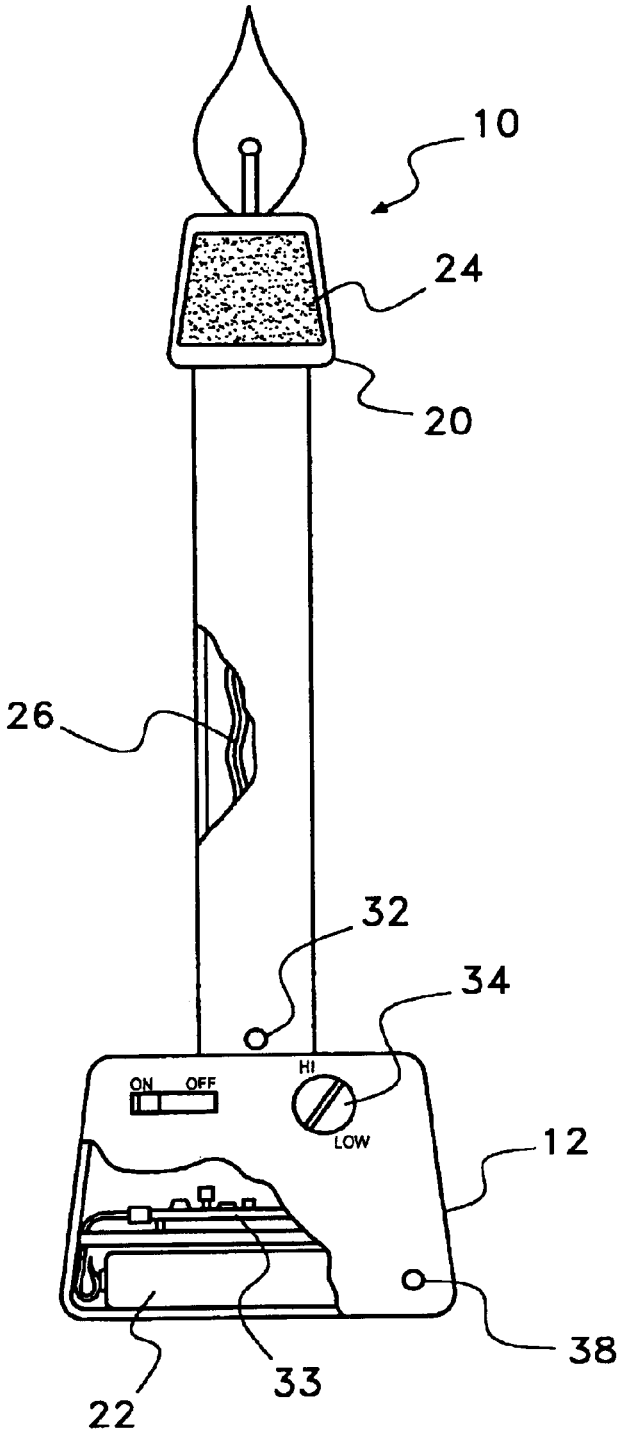
FIG. 2 is a partially fragmented view of the electric candle light shown in FIG. 1.

Referring to FIG. 2, it can be seen that within the base 12 of the electric candle light 10 are rechargeable batteries 22. The rechargeable batteries 22 are heavy. Thus, by placing the rechargeable batteries 22 in the base 12 of the electric light candle 10, the electric light candle 10 is provided with a low center of gravity that makes the electric light candle 10 easy to balance on a narrow window sill.

The rechargeable batteries 22 are connected with wires to both the light source 16 and at least one photoelectric cell 24. The light source 16 is positioned at the top of the electric candle light 10. The light source 16 can be a conventional light bulb. However, the use of at least one high output LED is preferred because the LED uses less electricity to produce a comparable amount of light. Light bulbs and LEDs are both manufactured to produce light in different colors. Accordingly, the light source 16 can produce white light, yellow light, red light or any other colored light desired by varying the type of light source used. The light source 16 is connected to the rechargeable batteries 22 with wires 26 that pass through the center of the candle shaft 14.

Most commercially available photoelectric cells have a black or otherwise dark appearance. This enables the photoelectric cell to efficiently absorb light energy. By molding the collar 20 of the electric candle light out of black plastic or another dark colored plastic, the presence of the photoelectric cell 24 on the collar 20 is unperceivable to a person who views the electric candle light 10 through the window. Accordingly, although the photoelectric cell 24 is on the exterior of the electric candle light 10, the photoelectric cell 24 is unperceivable due to the camouflage of its location.

The material of the photoelectric cell 24 can encircle the collar 20. However, only half of the collar 20 faces the window when the electric candle light 10 is placed in the window. Consequently, the photoelectric cell 24 need only be present on the half of the electric candle light 10 that faces the window. Since the present invention electric candle light 10 is most likely to be used by a homeowner in the winter months, it can be assumed that the photoelectric cell 24 on the collar 20 will be exposed to ambient daylight for no more than nine hours out of the day. Given this amount of ambient daylight, the size of the photoelectric cell 24 and the capacity of the rechargeable batteries 22 are calculated so that the rechargeable batteries 22 can be fully recharged by the photoelectric cell 24 in the period of the average available sunlight. For the size of the rechargeable batteries 22 selected, the light source 16 is selected to provide at least three hours of continuous illumination provided the power is available in the rechargeable batteries 22. If less bright light sources are used that draw less current, the light source 16 can remain dimly illuminated throughout the night.

To help reserve and prolong the amount of time the light source 16 can remain illuminated, the electric candle light has power saving features. First, an on/off switch 30 is provided that selectively connects and disconnects the light source 16 from the rechargeable batteries 22. If the on/off switch 30 is "off" the rechargeable batteries 22 can still be recharged by the photoelectric cell 24. However, the rechargeable batteries 22 are isolated from the light source 16 and cannot be drained by the light source 16. A homeowner may therefore elect to turn the electric candle light 10 on only at a selected hour of the evening. The use of the electric candle light 10 can therefore be reserved for a late night event.

The second power saving feature is an ambient light detector 32. The ambient light detector 32 faces the window and detects the level of ambient light. When the level of ambient light surpasses a predetermined minimum value, it can be assumed that it is during daylight hours. The ambient light detector 32 is attached to a small circuit board 33 within the base 12 that automatically disconnects the light source 16 from the rechargeable batteries 22. The electric candle light 10 therefore automatically turns "off" during daylight hours. This enables the batteries 22 to recharge without having to the experience the drain from the light source 16. However, once the ambient light detector 32 detects that the level of light has dropped below a threshold level, the control circuit automatically turns the electric candle light 10 "on". This connects the light source 16 to the rechargeable batteries 22 and causes the light source 16 to illuminate.

A control 34 may be provided so that a homeowner can selectively adjust the sensitivity of the control circuit. In this way the electric candle light 10 can be adjusted to the ambient light cycles of a specific home in a specific window. This prevents the electric candle light 10 from accidentally being activated by a passing cloud that momentarily dulls the light of the sun.

As is well known, it is possible for poor weather to block the sun for a few days. In such a scenario, the photoelectric cell 24 will not recharge the batteries 22. In this instance, a charge port 38 is provided that enables the rechargeable batteries 22 to be recharged by being plugged into an electrical outlet with a plug-in adaptor.

Figure 3:
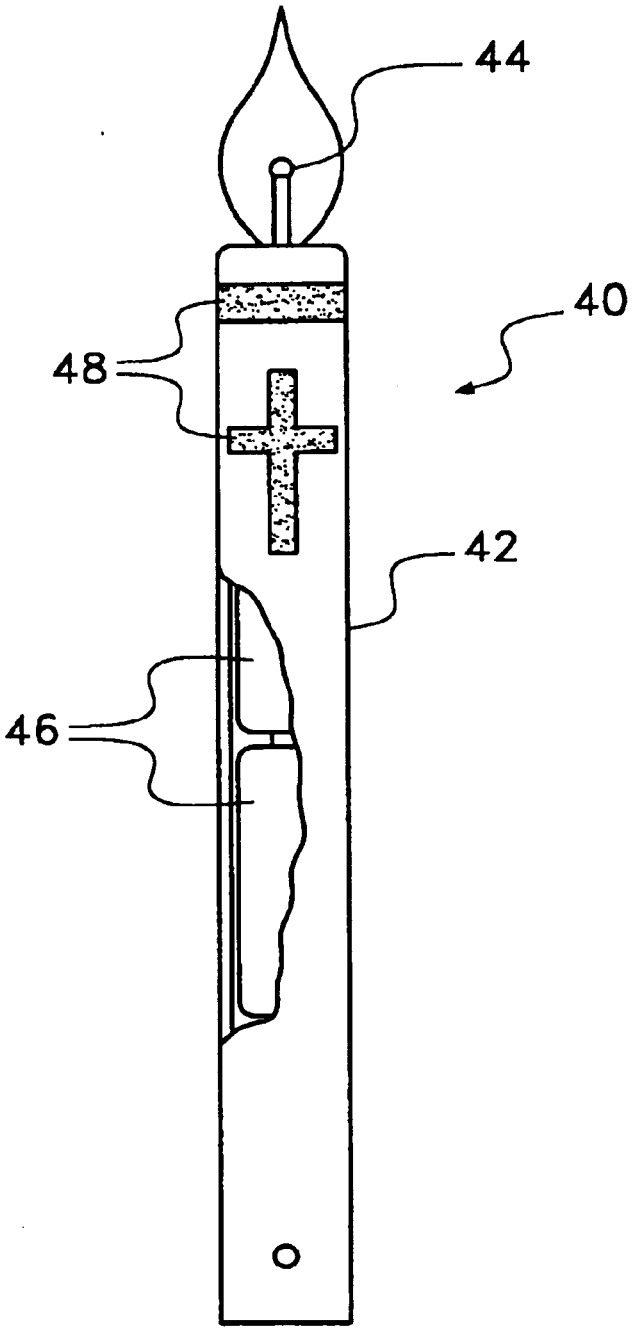
FIG. 3 is a partially fragmented view of a second embodiment of the present invention electric candle light.

Referring to FIG. 3, an alternate embodiment of the present invention electric candle light 40 is shown. In this embodiment, the electric candle light 40 does not have a base and does not have a collar. Rather, the electric candle light 40 is comprised of a shaft 42 and a light source 44 at the top of the shaft 42. The electric candle light 40 therefore has the same body shape as a traditional wax candle. The electric candle light 40 can therefore be placed in any existing candle holder or menorah that is designed to receive traditional wax candles.

Since the electric candle light 40 does not have a base, the rechargeable batteries 46 are positioned within the shaft 42 of the electric candle light 40. Furthermore, since no collar is present, a photoelectric cell must be placed on the exterior of the candle shaft 42. People often prefer white or lightly colored candles. Photoelectric cells tend to be dark. Accordingly the placement of the photoelectric cells on the candle shaft does produce an observable contrast. To preserve aesthetics, a photoelectric cell 48 can be formed as a band on the exterior of the shaft 42. Alternatively, a photoelectric cell 48 can be made into a design such as a Cross or the Star of David.

Figure 4:
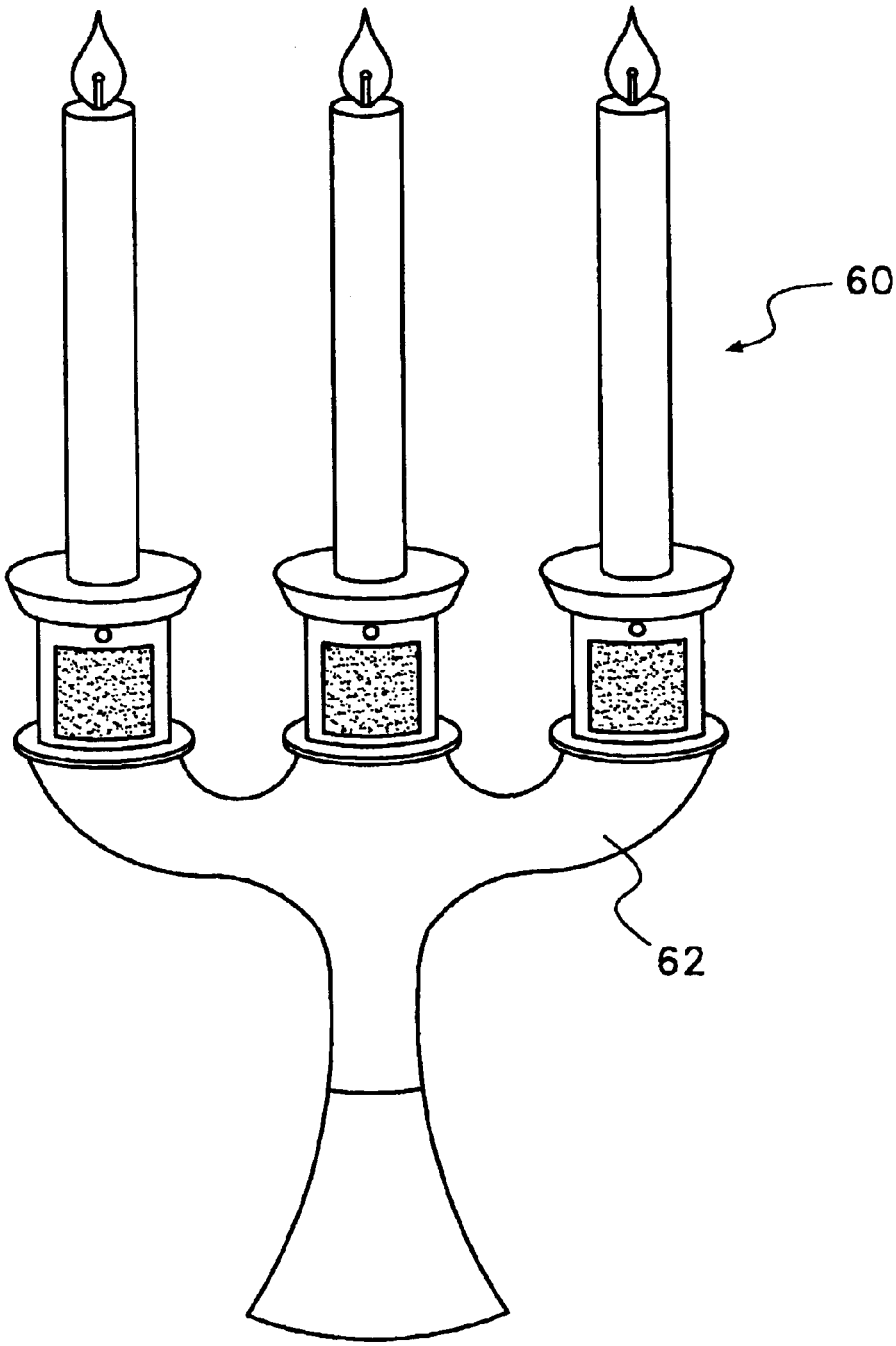
FIG. 4 is an exemplary embodiment of an alternate embodiment of the present invention system.

Referring to FIG. 4, yet another embodiment of the present invention electric candle light 60 is shown. In this embodiment, the electric candle light 60 includes a candle holder 62. The candle holder 62 can be shaped as a single candle holder, a candelabra or a menorah. Since the electric candle light 60 has the added space of the candle holder 62, larger batteries can be used. This is particularly useful if multiple light sources are to be illuminated simultaneously. Furthermore, the control circuit within the electric candle light can be made to include a timer. The various light sources 64 can therefore be preprogrammed to turn on and off at different times of the night. In the case of a menorah, the menorah can be programmed to light one extra light source each night during the eight day Chanukah celebration.

It will be understood that the embodiments of the present invention electric candle light that are described and illustrated herein are merely exemplary and a person skilled in the art can make many variations to the embodiments shown without departing from the scope of the present invention. For example, there are many different styles of candles, candle holders and candle collars. Any prior art style candle, candle holder and/or candle collar can be adapted for use with the present invention. All such variations, modifications and alternate embodiments are intended to be included within the scope of the present invention as defined by the appended claims.

What is claimed is:

1. An electric candle light assembly, comprising:

an elongated shaft having a top end, a bottom end, and an exterior surface, wherein said elongated shaft defines an internal space;

a light source disposed at said top end of said elongated shaft;

a collar positioned around said elongated shaft below said light source at said top end of said elongated shaft;

a photoelectric cell disposed on said collar a rechargeable battery coupled to said light source and said photoelectric cell, wherein said rechargeable battery supplies electricity to said light source and wherein said rechargeable battery is recharged by said photoelectric cell.

2. The assembly according to claim 1, wherein said elongated shaft and said light source combine to have the appearance of a candle.

3. The assembly according to claim 1, wherein said rechargeable battery is disposed within said internal space of said elongated shaft.

4. The assembly according to claim 1, wherein said photoelectric cell extends around no more than half of said collar.

5. The assembly according to claim 1, further including and on/off switch for selectively connecting said rechargeable battery to said light source.

6. The assembly according to claim 1, further including an ambient light detector and a control circuit that disconnects said rechargeable battery from said light source when light levels detected by said ambient light detector surpass a predetermined minimum value.

7. The assembly according to claim 1, further including a base, wherein said base is disposed below said bottom end of said elongated shaft and supports said elongated shaft in a vertical orientation.

8. The assembly according to claim 7, wherein said base is shaped as a candle holder.

9. The assembly according to claim 7, wherein said rechargeable battery is disposed within said base.

10. An electric candle light assembly having the same shape as a traditional wax candle, said assembly comprising:

an elongated shaft having a top end, a bottom end, and a cylindrical exterior surface, wherein said elongated shaft defines an internal space;

a light source disposed at said top end of said elongated shaft;

a photoelectric cell inset into said cylindrical exterior surface of said elongated shaft and conforms in shape to said cylindrical exterior surface of said elongated shaft, wherein said photoelectric cell is positioned between said top end and said bottom end of said elongated shaft;

a rechargeable battery disposed within said internal space of said elongated shaft, wherein said rechargeable battery supplies electricity to said light source and wherein said rechargeable battery is recharged by said photoelectric cell.

11. The assembly according to claim 10, wherein said elongated shaft and said light source combine to have the appearance of a candle.

12. The assembly according to claim 10, wherein said elongated shaft has two opposing sides on said external surface and said photoelectric cell is inset only on one of said opposing sides.

13. The assembly according to claim 10, wherein said photoelectric cell is inset along a band that encircles said external surface of said elongated shaft.

14. The assembly according to claim 10, wherein said photoelectric cell is inset on said cylindrical external surface of said elongated shaft in a predetermined decorative pattern.

* * * * *